US005743637A

United States Patent [19]

Ogier

[11] Patent Number: 5,743,637

[45] Date of Patent: Apr. 28, 1998

[54] VENTURI MIXING VALVE FOR USE IN MIXING LIQUIDS

[75] Inventor: Ray Ogier, Milton, Canada

[73] Assignee: Chem Financial, Inc., Ontario, Canada

[21] Appl. No.: 555,783

[22] Filed: Nov. 9, 1995

[51] Int. Cl.[6] ..... B01F 5/00

[52] U.S. Cl. ..... 366/163.2; 366/181.5; 366/338; 138/44

[58] Field of Search ..... 366/163.2, 174.1, 366/181.5, 181.7, 336, 337, 338, 340; 138/37, 44

[56] References Cited

U.S. PATENT DOCUMENTS

| | | | |
|---|---|---|---|
| 2,831,754 | 4/1958 | Manka | 366/181.5 X |
| 3,208,829 | 9/1965 | Terenzi . | |
| 3,712,341 | 1/1973 | Constantin et al. | 138/44 |
| 4,057,223 | 11/1977 | Rosenberger . | |
| 4,274,749 | 6/1981 | Lake et al. . | |
| 4,482,704 | 11/1984 | Luetzelschwab . | |
| 4,642,222 | 2/1987 | Brazelton . | |
| 4,660,988 | 4/1987 | Hara et al. . | |
| 4,664,528 | 5/1987 | Rodgers et al. . | |
| 4,747,691 | 5/1988 | Hoffland . | |
| 4,753,535 | 6/1988 | King | 366/174.1 X |
| 4,778,280 | 10/1988 | Brazelton . | |
| 4,863,277 | 9/1989 | Neal et al. . | |
| 5,052,486 | 10/1991 | Wilson . | |
| 5,211,475 | 5/1993 | McDermott . | |
| 5,372,421 | 12/1994 | Pardikes . | |
| 5,452,955 | 9/1995 | Lundstrom | 366/163.2 |

FOREIGN PATENT DOCUMENTS

| | | | |
|---|---|---|---|
| 1408004 | 7/1988 | U.S.S.R. | 366/174.1 |

*Primary Examiner*—Charles E. Cooley

*Attorney, Agent, or Firm*—Gifford, Krass, Groh, Sprinkle, Patmore, Anderson & Citkowski, P.C.

[57] ABSTRACT

A mixing valve having a mixing passage formed by a tapered concentric reduction member for forming a venturi, a pair of baffles supporting the reducing member to form a mixing chamber where liquid from secondary inputs is metered by the venturi into an axial flow of liquid. The mixing valve is particularly adapted for use with a method of hydrating concentrated polymer and mixing in recycled polymer from an eductor. The method includes passing water through a venturi, metering a flow of neat polymer and a flow of recycled polymer from the eductor into the mixing chamber by the venturi effect.

7 Claims, 1 Drawing Sheet

VENTURI MIXING VALVE FOR USE IN MIXING LIQUIDS

BACKGROUND OF THE INVENTION

I. Field of the Invention

A method and an apparatus for use in mixing liquids and, more particularly, a method and an apparatus for use in hydration of concentrated polymeric solutions.

II. Background of the Invention

Polymers are manufactured and shipped in a deactivated form to the location where they will be used. At that location, it is necessary to activate or invert the polymers before they can be used. Usually that means that the polymer must be mixed with water or other chemical to provide an electrolyte which can change the polymer from an inactive state into an active state which can be mixed.

Various devices are known for mixing water soluble concentrated polymer solutions (CPS) and water together to produce a diluted polymer solution (DPS). The emulsification of (CPS) is typically accomplished by delivering a supply of CPS from a storage tank through a metering pump and a supply line to an eductor system. The eductor system includes a high speed centrifugal pump where the CPS is mixed with water to form a diluted polymer solution (DPS). The diluted polymer solution is then delivered to an aging tank where the DPS is stored for aging.

Typical of such an apparatus is one shown in U.S. Pat. No. 5,372,421 to Pardikes. Pardikes discloses an apparatus for a four stage activation of polymer. The polymer is premixed in a manifold containing a static mixer. Then, the polymer is blended with water within a centrifugal pump. The outflowing blended stream from the centrifugal pump is divided. One part of the blended stream is fed back through the static mixer to the centrifugal pump. The other part of the stream is delivered to a storage tank for processing. Control of the proportions of neat polymer or CPS and water is critical to the efficiency of the hydration process. In the previously known systems it has been difficult to properly meter the flow of concentrated polymer into proper proportion with the water.

SUMMARY OF THE INVENTION

Accordingly, the object of the invention is to provide a new, improved device and method of activating polymers. In particular, it is an object of the invention to utilize a mixing valve having a venturi in which service water is mixed with a predetermined amount of concentrated or neat polymer and recycled mixed polymer from the eductor by the suction of the venturi. The blended mixture is then delivered to an eductor before dividing the output into a stream for recycling and a stream for processing.

The mixing valve includes a housing having an axial chamber having an inner surface extending between a primary input port at one end and an output port at an opposite end. A reducer member is mounted concentrically within the axial chamber by baffles. The reducer member tapers radially inwardly from an input end toward an output end so that fluid passing between the inner surface of the cylinder and reducer member is passed through a mixing chamber having a venturi. The mixing chamber is formed between a pair of baffles and the reducer.

A pair of secondary inlets is provided to deliver neat polymer and recycled diluted polymer into the mixing chamber. The venturi effect of the water flowing through the axial chamber over the reducer member through the mixing chamber results in precise metering of the liquids from the secondary inlets into the mixing chamber, thereby providing for effective control of the mixing process.

BRIEF DESCRIPTION OF THE DRAWINGS

The preferred embodiments of the invention are shown in the attached drawings, wherein like reference characters refer to like parts throughout the several views, and in which.

DETAILED DESCRIPTION OF THE PREFERRED EMBODIMENTS

Figure 3:
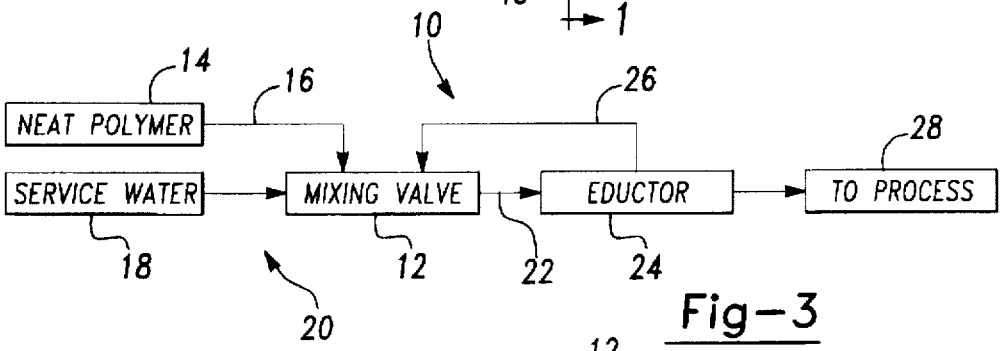
FIG. 3 is a schematic view of a system utilizing the mixing valve in accordance with the invention.

In FIG. 3, an improved polymer activating system 10 is shown schematically. The activating system includes an improved mixing valve 12 for diluting concentrated liquid polymer or neat polymer to form an activated diluted polymer solution suitable for further processing.

As shown in FIG. 3, neat polymer is delivered from a tank 14 to the mixing valve 12 through a conduit 16. Service water or solvent is delivered from a source 18 of water through a conduit 20 in FIG. 1 to the mixing valve 12. As discussed more fully below, the neat polymer is blended with the service water and recycled polymer and delivered by a conduit 22 to an eductor 24 where energy is imparted to the blend by a centrifugal force. The output of the eductor is divided into two portions. One portion is recycled by a conduit 26 to the mixing valve 12. The other portion is fed to a tank 28 by a conduit for use in further processing.

Figure 1:
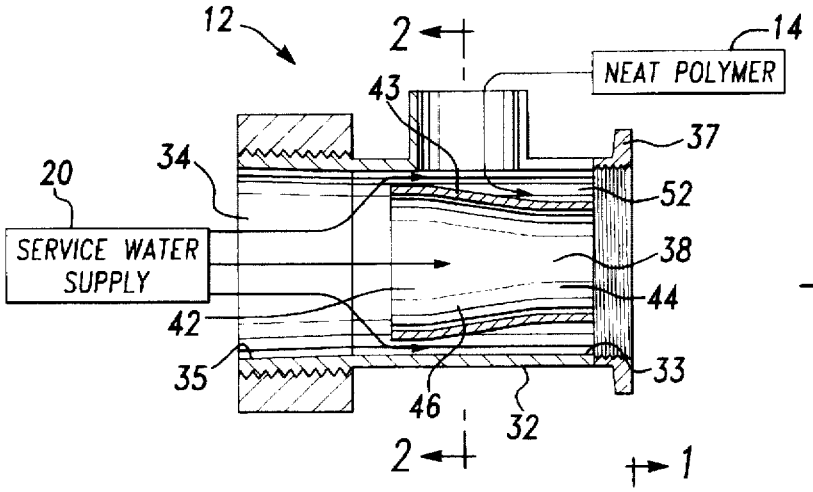
FIG. 1 is a sectional view taken along lines 1—1 of FIG. 2 the mixing valve in accordance with the invention.

As best shown in FIG. 1, the mixing valve 12 has a housing 32. The housing 32 has an inner surface 33 defining an axial chamber 34 extending between a primary input port 35 and an output port 36. The input port 35 is provided with a hexagonal adapter 39 for connection to the conduit 20 for delivering service from the water supply 18. The output port has a service connector 37 formed for connection to the conduit 22 for delivery of the output mixture to the eductor 24.

Figure 2:
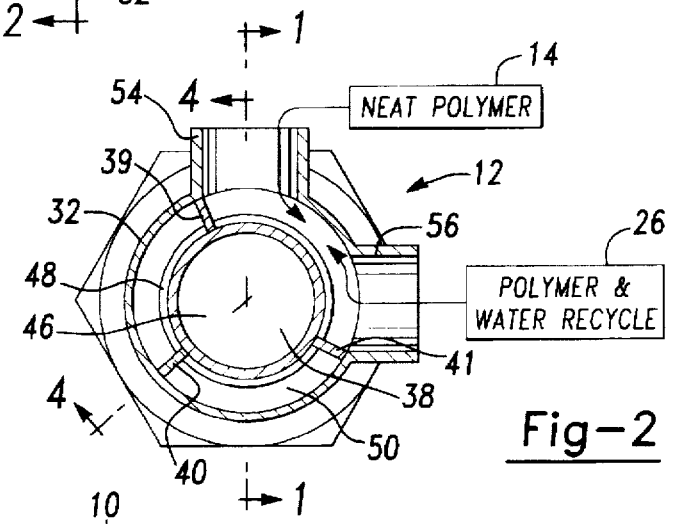
FIG. 2 is a cross-sectional view taken along lines 2—2 of FIG. 1 of the mixing valve in accordance with the invention.
Figure 4:
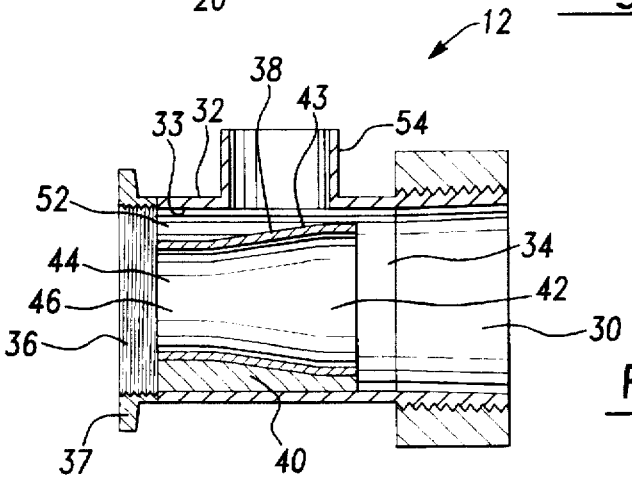
FIG. 4 is a cross-sectional view of the mixing valve taken along lines 4—4 of FIG. 2 in accordance with the invention.

As shown in FIGS. 1, 2 and 4, a concentric reducer 38 is mounted within the axial chamber 34 by three radially extending baffles 39, 40, 41. The reducer 38 extends coaxially with the housing 32 and has an inflow end 42 having an outer diameter slightly smaller than the diameter of the axial chamber 34. The reducer 38 tapers radially inwardly from the inflow end 42 towards the outflow end 44 to form a venturi. The reducer 38 is formed of a rigid material, such as stainless steel, and is positioned to permit service water to flow through the center passage 46 as well as between the inner surface of the hosing 32 and an outer surface 43 of the reducer 38.

As best shown in FIG. 4, the baffles 39, 40 and 41 form a pair of flow-through chambers 48, 50 extending between pairs of baffles 39, 40, and baffles 40, 41. A mixing chamber 52 is formed between baffle 41 and baffle 39. The flow-through chambers 48, 50 extend circumferentially through an arc of approximately 108° each and the mixing chamber 52 extends circumferentially approximately 140°.

As best shown in FIG. 2, a neat polymer inlet coupling 54 and a recycled mixed inlet polymer coupling 56 are positioned 90° circumferentially on the housing 32 radially outwardly from the reducer 38 to deliver the fluids to the mixing chamber 52. The neat polymer coupling 54 is provided for connection to the conduit 16 for delivering undiluted neat polymer to the mixing valve 12. Likewise, the recycled neat polymer coupling 56 is provided to recycle blended polymer from the eductor 24 to the mixing chamber 52.

As shown in FIG. 3, the method includes delivering water or solvent through the primary inlet port to the mixing chamber where a venturi is formed at a constant flow rate. Then the recycled polymer from the eductor and neat polymer from the tank are metered into the mixing chamber through the inlets. Because the mixing chamber 52 is in the form of a venturi, a constant rate of suction is generated at the inlet couplings 54, 56 for a particular flow rate of water through the mixing chamber 52. This constant rate of suction permits precise metering of the neat polymer and recycled diluted polymer solution into the mixing chamber 52. The blended solution formed in the mixing chamber 52 is then mixed with the water from the center passage 46 and flow-through chambers 48, 50 as it is carried to the output end of the housing and the conduit 22 delivering the blended solution to the eductor 24. In the eductor, energy is imparted to the mixture and then the output of the eductor is divided into two streams. One portion is recycled by conduit 26 to the mixing chamber and the other portion is delivered to a tank for processing.

It is apparent that additional mixing chambers can be formed in the valve by adding inlets to communicate with the flow-through passages. Thus, one skilled in the art will readily recognize from such a discussion, and from the accompanying drawings and claims that various changes, modifications, and variations can be made therein without departing from the spirit and scope of the invention as defined in the following claims.

I claim:

1. A mixing valve for use in mixing liquids, said valve comprising:

a housing having an axial passageway extending between a primary inlet and an outlet;

a reducer member mounted to said housing within said passageway by at least two baffles extending between said reducer and said housing, said reducer member having a central throughbore, said reducer member tapering radially inwardly from an inflow end to an outflow end to form a venturi, said reducer member and said housing extending coaxially with said passageway and forming a mixing chamber therebetween in fluid communication with said inlet, said passageway conveying a flow of a first liquid from said inlet to said mixing chamber and said central throughbore of said reducer member; and a pair of secondary inlets formed in said housing positioned proximate said reducer member and extending outwardly from said housing for delivering fluids into said mixing chamber.

2. The mixing valve of claim 1, wherein said pair of secondary inlets are separated 90° circumferentially on said housing.

3. The mixing valve of claim 1, wherein said at least two baffles comprises three baffles, each of said baffles extending from said inflow end to said outflow end of said reducer member.

4. A mixing valve for use in mixing liquids, said valve comprising:

a housing having an axial passageway extending between a primary inlet and an outlet;

a reducer member mounted to said housing within said passageway, said reducer member having a central throughbore, said reducer member tapering radially inwardly from an inflow end to an outflow end to form a venturi;

at least two baffles extending between said reducer member and said housing to form a mixing chamber; and a pair of secondary inlets formed in said housing for delivering fluids into said mixing chamber, said pair of secondary inlets being separated 90° circumferentially on said housing.

5. The mixing valve of claim 4, wherein said at least two baffles comprises three baffles, each of said baffles extending from said inflow end to said outflow end of said reducer member.

6. A mixing valve for use in mixing liquids, said valve comprising:

a housing having an axial passageway extending between a primary inlet and an outlet;

a reducer member mounted to said housing within said passageway, said reducer member having a central throughbore, said reducer member tapering radially inwardly from an inflow end to an outflow end to form a venturi;

three baffles extending between said reducer member and said housing to form a mixing chamber, each of said baffles extending from said inflow end to said outflow end of said reducer member; and a pair of secondary inlets formed in said housing for delivering fluids into said mixing chamber.

7. The mixing valve of claim 6, wherein said pair of secondary inlets are separated 90° circumferentially on said housing.

* * * * *